United States Patent [19]

Walpin et al.

[11] Patent Number: 4,850,068

[45] Date of Patent: Jul. 25, 1989

[54] MULTI-DIMENSIONAL PILLOW

[75] Inventors: Arline M. Walpin; Lionel A. Walpin, both of Los Angeles, Calif.

[73] Assignee: Roloke Co., Culver, Calif.

[21] Appl. No.: 67,938

[22] Filed: Jun. 29, 1987

[51] Int. Cl.[4] ..... A47C 20/02

[52] U.S. Cl. ..... 5/434; 5/436

[58] Field of Search ..... 5/434, 436, 437, 442

[56] References Cited

U.S. PATENT DOCUMENTS

| | | | |
|---|---|---|---|
| 2,167,622 | 8/1939 | Bentivoglio | 5/442 X |
| 2,940,087 | 6/1960 | Kiefer | 5/436 |
| 3,243,828 | 4/1966 | McCarty | 5/437 |
| 3,829,917 | 8/1974 | De Laittre et al. | 5/436 |
| 4,320,543 | 3/1982 | Dixon | 5/434 |
| 4,494,261 | 1/1985 | Morrow | 5/436 |
| 4,574,411 | 3/1986 | Yagi | 5/434 |

*Primary Examiner*—Alexander Grosz
*Assistant Examiner*—Michael F. Trettel
*Attorney, Agent, or Firm*—Lyon & Lyon

[57] ABSTRACT

A multi-dimensional pillow comprising a core having a cross sectional thickness gradient along one dimension and at least one geometric piece attached to the core parallel to the direction of the thickness gradient. When the user is in the back-lying position, the geometric piece maintains either the normal lordotic curve of the neck or flexion of the neck and the thickness gradient biases the head in the downslope direction causing a controlled rotation of the head resulting in a traction effect on the upslope side of the neck. The traction effect is due to the coupled easy natural biomechanical motions of side bending and side rotation of the neck to the same side.

3 Claims, 3 Drawing Sheets

MULTI-DIMENSIONAL PILLOW

BACKGROUND

1. Field of the Invention

The field of the invention is support pillows and more particularly pertains to pillows for providing support and traction for the neck.

2. The Prior Art

The current design of pillows for providing support for and stretching of the neck are basically concerned only with providing controlled support and traction in one dimension. A pillow of this type is described in U.S. Pat. No. 3,521,310, entitled "Pillow Construction", which issued to Monte Greenawalt on July 21, 1970. Pillows of this type are one-dimensional in that they cannot provide controlled support or traction in multiple planes from a single lying position. For example, these pillows are designed such that when the user is lying on his or her back, the back-lying position, the pillow will provide one dimensional controlled support and traction, i.e., either support the neck to help control and maintain the normal lordotic curve of the neck or control and maintain flexion of the neck. These pillows are also designed such that when the user is lying on his or her side, the side-lying position, the pillow will provide one dimensional controlled support and traction, i.e., support the neck while providing a traction effect on the side of the neck opposite the pillow. For example, when the user lies on his or her right side, the right side of the neck is supported and the left side of the neck receives a traction effect. These prior art pillows, are not designed to provide either controlled neck flexion support or traction effect while at the same time providing a controlled side traction effect (i.e., sidebending-/rotation). Also they are not designed to provide either controlled right or left side bending/rotation traction effect while at the same time providing a controlled flexion or extension traction effect. In other words the controlled support and/or traction these pillows are designed to provide is one dimensional i.e., essentially all in the same plane.

Although these pillows may provide some side traction effect with some people in the backlying position, the side traction effect is not controlled or necessarily reliable. This is because any side traction effect that might be achieved from these prior art pillows when used in the back-lying position is largely by virtue of the weight of the head alone and, as such, will vary among users. In fact, some users will derive no beneficial side traction effect on muscles and joints when using these pillows in the back-lying position, while others may overstretch or overcompress those same muscles or joints. When these prior art pillows are used in the side-lying position, the effects achieved are also only controlled in one dimension since the user may flex or extend the head and neck depending upon the habit and or the weight of the head. The one dimensional control limitation of the prior art pillows, among other things, prevents users from being able to enjoy the fuller benefits and comforts that may be achieved from the traction and support effects of these pillows.

SUMMARY OF THE INVENTION

This invention pertains to a pillow that is comfortable to the user yet provides a controlled multi-dimensional therapeutic effect. The pillow of the present invention is designed such that it can provide all of the normal one dimensional benefits of the prior art and, in addition, provide a unique three dimensional effect to the user. While the user is in the back-lying position the pillow of the present invention can provide both the support needed to maintain either the lordotic neck curve or controlled flexion of the neck in one dimension as well as controlled side traction effects in a second dimension. While the user is in the side-lying position the pillow of the present invention provides both the support for the side bending curve of the neck which means controlled side traction effects in one dimension together with either controlled extension or flexion of the neck in a second dimension.

The invention comprises a core having a cross sectional thickness gradient along one dimension and at least one geometric piece attached to the core parallel to the direction of the thickness gradient. When the user is in the back-lying position, the geometric piece helps maintain the normal lordotic curve of the neck and the thickness gradient biases the head in the downslope direction causing a controlled rotation of the head and neck resulting in a traction effect on the upslope side of the neck. The traction effect is due to the easy natural coupled biomechanical motions of side bending and side rotation of the neck both to the same side. Two raised borders attached perpendicular to the direction of the thickness gradient assist in providing controlled rotation of the head. In the preferred embodiment, the core, including the raised contoured borders and the geometric piece are encased in an overwrap to smooth out any sharp breaks between the various pieces, providing maximum comfort to the user. As a result of this unique configuration, the invention can provide controlled three dimensional support and traction effects. In addition the user can also use the pillow in the same manner as the prior art pillows, merely by rotating it ninety degrees.

Accordingly, it is one object of this invention to provide a pillow that is capable of providing support for the lordotic curve and a controlled side traction effect on the neck muscles and vertebrae from a single lying position of the user. Other and further objects and advantages of the various aspects of this invention appear hereafter.

DETAILED DESCRIPTION OF THE PREFERRED EMBODIMENT

Figure 1:
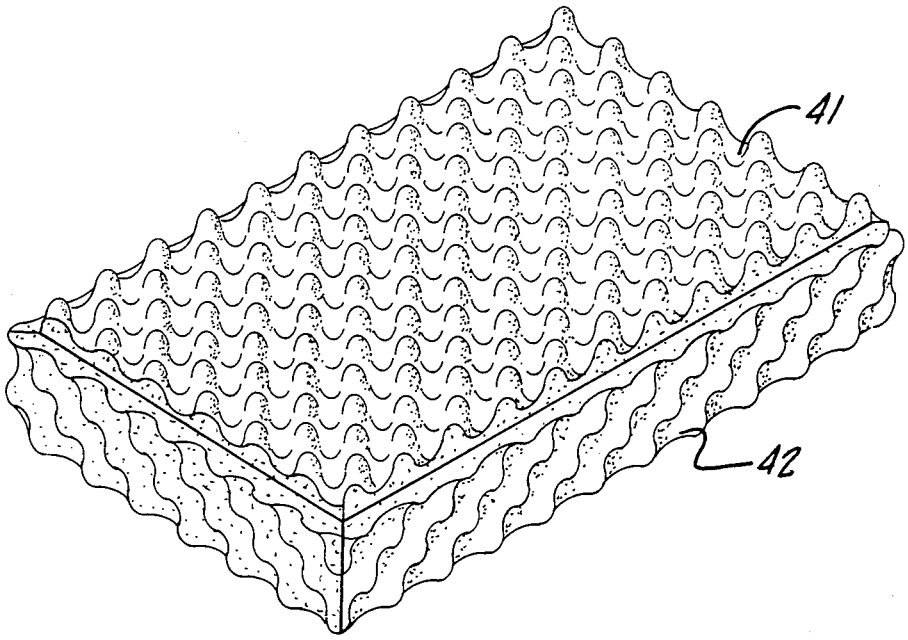
FIG. 1 is a plan view of the preferred embodiment of the invention from the level face with an overwrap of sculptured foam.
Figure 2:
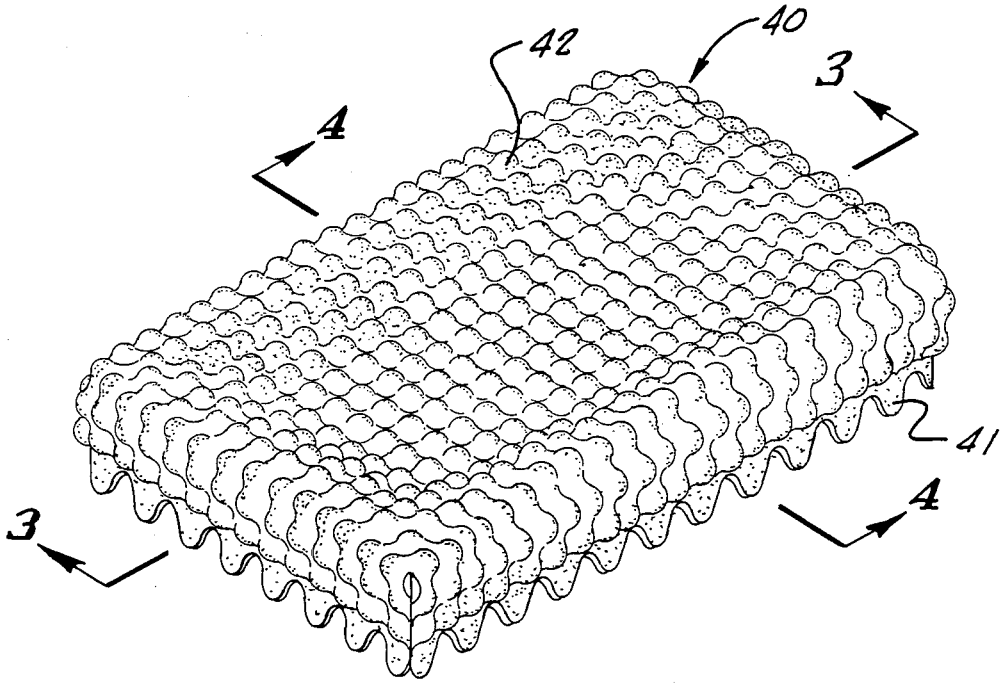
FIG. 2 is a plan view of the preferred embodiment of the invention from the sloped face with an overwrap of sculptured foam.
Figure 3:
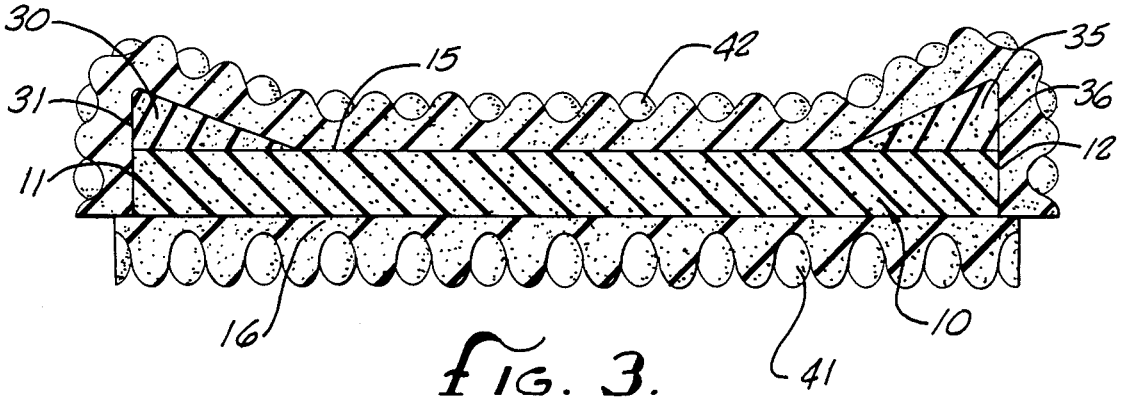
FIG. 3 is a cross sectional view of the preferred embodiment of the invention taken along plane 3—3 of FIG. 2.
Figure 4:
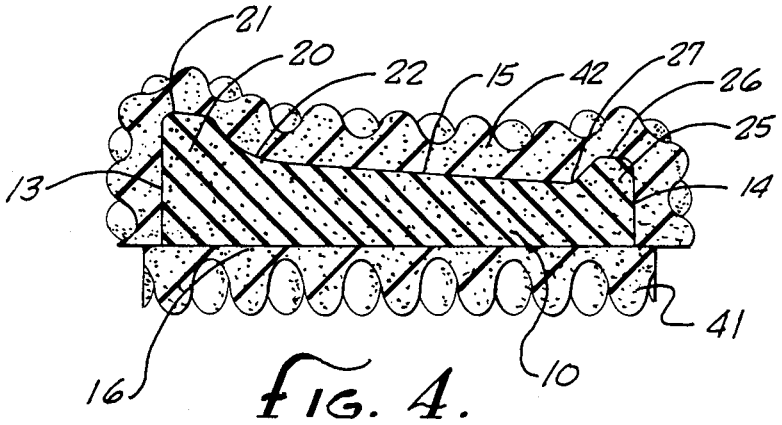
FIG. 4 is a cross sectional view of the preferred embodiment of the invention taken along plane 4—4 of FIG. 2.
Figure 5:
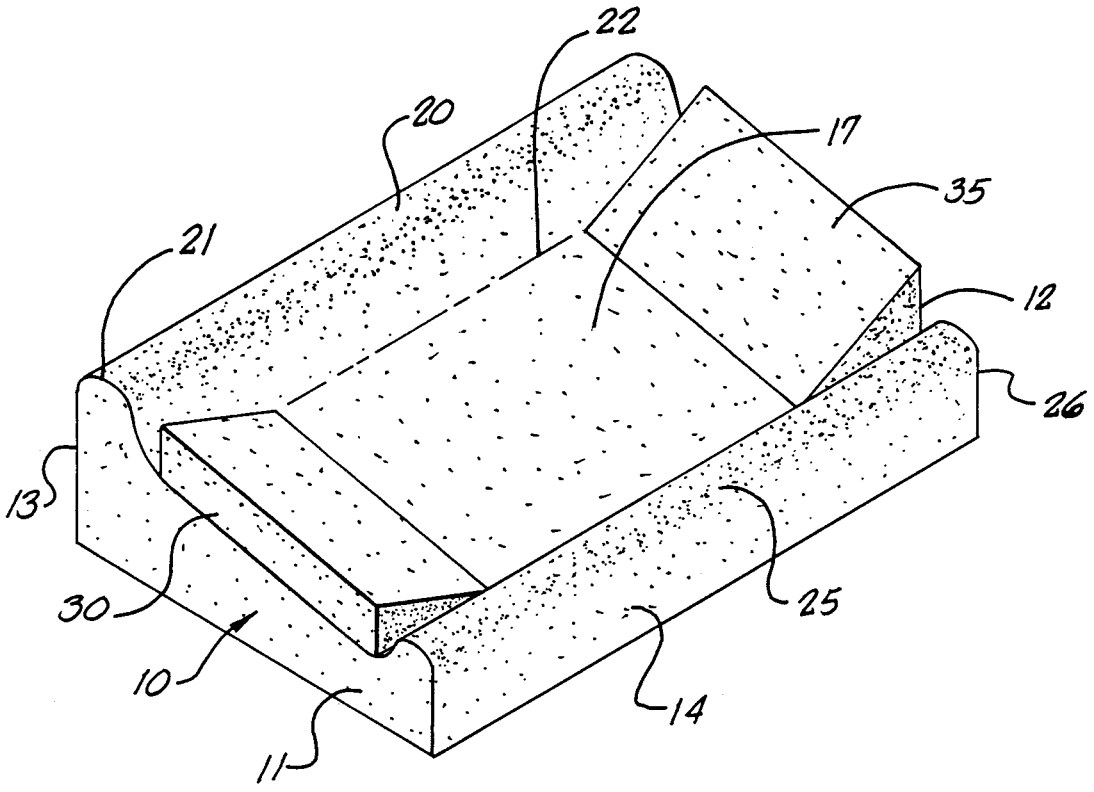
FIG. 5 is a plan view of the preferred embodiment of the invention from the sloped face without an overwrap.

Referring to FIGS. 3, 4 and 5, the preferred embodiment has a core 10 that is rectangular in shape. The core 10 has four edges, a first and second widthwise edge 11 and 12 and a thick and a thin lengthwise edge 13 and 14, and two faces, a sloped face 15 and a level face 16. The core 10 has a cross sectional thickness gradient across its width forming the sloped face 15. The thickness gradient in the preferred embodiment is approximately 0.11. Since the gradient is dependent upon the physical characteristics of the user and his or her desired need, the desired gradient may vary. The level face 16 of the core 10 is substantially perpendicular to all four edges.

Two raised borders are formed along both of the lengthwise edges 13 and 14 protruding from the sloped face 15. In the preferred embodiment these raised borders are an integral part of the core 10. To achieve maximum versatility the raised borders protrude different heights from the surface of the sloped face 15. A high raised border 20 is formed at the thick lengthwise end 13 of the core 10 and a low raised border 25 is formed at the thin lengthwise end 14 of the core 10. To assist in providing proper support to the user's neck and head, the two raised borders of the preferred embodiment have a rounded contour along their tops 21 and 26 and have concave bases 22 and 27 to blend into the surface of the sloped face 15 and provide structural support. The area between the high raised contoured border base 22 and the low raised contoured border base 27 forms a central portion 17.

At least one geometric piece is attached to the core 10 parallel to the direction of the thickness gradient. In the preferred embodiment a first geometric piece 30 and a second geometric piece 35 are attached to the core at the widthwise edges 11 and 12. The geometric pieces of the preferred embodiment are triangular in cross section and, more particularly, the cross section of the geometric pieces are right triangles. The right triangular geometric pieces are attached to the core such that the short legs 31 and 36 of the respective geometric pieces 30 and 35 are flush with the widthwise edges 11 and 12 of the core 10. In this configuration, when the user is in the back-lying position, the geometric piece supports the user's neck, maintaining the normal lordotic curve of the neck of the user, while the thickness gradient provides controlled rotation in the downslope direction. The low raised border 25 can be used to control the degree of traction effect of the upslope side of the user'neck. In the preferred embodiment the core 10 is fabricated from a material having a higher density than the geometric pieces 30 and 35.

It should be noted that the short legs 31 and 36 of the geometric pieces can be made of differing dimensions. Having different dimensions, e.g., having short leg 31 be 2 inches and short leg 36 be 2 and a half inches, increases the versatility of the pillow by allowing users with different body structures to achieve the same benefits from a single product.

An overwrap 40 encases the core 10 and geometric pieces 30 and 35 to maintain a high degree of comfort for the user and provide a cushioning effect on the sloped face 15 to assist in the controlled rotation of the user's head. In the preferred embodiment the overwrap 40 is a sculptured foam, preferably polyurethane which has a lower density than the core 10. A deep pile sculptured foam overwrap 41 covers the level face 16 and a shallow pile scupltured foam overwrap 42 encases the raised contoured borders 20 and 25, the geometric pieces 30 and 35 and the sloped face 15 of the core 10.

Having thus described the preferred embodiments, the many advantages of the invention can be readily seen. A few of them are listed herein.

In addition to the multi-dimensional support and traction effect achieved in the back-lying position it can be seen that by rotating the preferred embodiment 90 degrees, the user can have the normal one dimensional support as provided by the prior art pillows. In addition, the inclusion of a high raised contoured border 20 and a low raised contoured border 25 results in the preferred embodiment being capable of providing the same benefits to multiple users with differing body structures. A large boned person can use the high raised contoured border whereas a smaller boned person can use the low raised contoured border.

Additionally, if the sloped face 15 is placed facing the bed and the low raised contoured border 25 is placed under the user's neck in the back-lying position, the tissues along the back side of the user's neck will achieve a traction (or separation) effect while the tissues along the front side of the neck will be brought closer together (or slackened).

Thus, a multi-dimensional support and traction pillow for inter alia providing support to maintain the normal lordotic curve and side traction of a user's neck from a single lying position has been described. While embodiments, applications and advantages of the invention have been shown and described, as would be apparent to ones skilled in the art, many more embodiments, applications and advantages are possible without deviating from the inventive concepts described herein. The invention, therefore, is not to be restricted except in accordance with the spirit of the appended claims.

We claim as follows:

1. A pillow comprising a core comprising a first and second widthwise edge, a thick lengthwise edge and a thin lengthwise edge, said core also comprising a low raised contoured border extending the length of said thin lengthwise edge and a high raised contoured border extending the length of said thick lengthwise edge; said low raised contoured border and said high raised contoured border each having a base; said core having a central portion defined by said high raised contoured border base and said low raised contoured border base; said central portion having a thickness gradient from said high raised contoured border base to said low raised contoured border base;

a first piece having a triangular cross section attached to said core at said first widthwise edge between said high raised contoured border base and said low raised contoured border base;

a second piece having a triangular cross section attached to ssid core at said second widthwise edge between said high raised contoured border base and said low raised contoured border base;

a sculptured overwrap encasing said core, said first triangular piece and said second triangular piece, said sculptured overwrap comprising a deep pile convolution region and a shallow pile convolution region, said shallow pile convolution region encasing said high raised contoured border, said low raised contoured border, said central portion, said first triangular piece and said second triangular piece, said deep pile convolution encasing the remainder of said core.

2. The pillow of claim 1 wherein said first piece has a cross section in the shape of a right triangle and said second piece has a cross section in the shape of a right triangle.

3. The pillow of claim 2 wherein the short leg of said first piece is shorter in length than the short leg of said second piece.

* * * * *